US010680330B2

(12) United States Patent
Su et al.

(10) Patent No.: US 10,680,330 B2
(45) Date of Patent: Jun. 9, 2020

(54) ANTENNA AND ELECTRONIC DEVICE

(71) Applicant: Beijing Xiaomi Mobile Software Co., Ltd., Beijing (CN)

(72) Inventors: Yuquan Su, Beijing (CN); Hai Zhao, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 60 days.

(21) Appl. No.: 16/019,204

(22) Filed: Jun. 26, 2018

(65) Prior Publication Data

US 2018/0375209 A1 Dec. 27, 2018

(30) Foreign Application Priority Data

Jun. 27, 2017 (CN) ..... 2017 1 0497977

(51) Int. Cl.

| | |
|---|---|
| ***H01Q 5/30*** | (2015.01) |
| ***H01Q 7/00*** | (2006.01) |
| ***H01Q 5/328*** | (2015.01) |
| ***H01Q 1/44*** | (2006.01) |
| ***H01Q 5/335*** | (2015.01) |
| ***H01Q 1/24*** | (2006.01) |

(Continued)

(52) U.S. Cl.

CPC ..... *H01Q 5/30* (2015.01); *H01Q 1/243* (2013.01); *H01Q 1/44* (2013.01); *H01Q 1/48* (2013.01); *H01Q 5/328* (2015.01); *H01Q 5/335* (2015.01); *H01Q 7/00* (2013.01); *H01Q 9/0407* (2013.01)

(58) Field of Classification Search

CPC ..... H01Q 5/30; H01Q 5/335; H01Q 1/44; H01Q 5/328; H01Q 7/00; H01Q 9/0407; H01Q 1/48; H01Q 1/243; H01Q 1/38; H01Q 1/244

USPC ..... 343/745

See application file for complete search history.

(56) References Cited

U.S. PATENT DOCUMENTS

| | | | | |
|---|---|---|---|---|
| 7,336,239 | B2 * | 2/2008 | Takei | H01Q 1/241 343/850 |
| 7,420,511 | B2 * | 9/2008 | Oshiyama | H01Q 1/243 343/700 MS |

(Continued)

FOREIGN PATENT DOCUMENTS

| | | | |
|---|---|---|---|
| CN | 1992434 | A | 7/2007 |
| CN | 102696149 | A | 9/2012 |

(Continued)

OTHER PUBLICATIONS

First Office Action of Chinese Patent Application No. 201710497977.2, from the Chinese Patent office, dated Apr. 17, 2019, 15 pages.

(Continued)

*Primary Examiner* — Khai M Nguyen

(74) *Attorney, Agent, or Firm* — Arch & Lake LLP

(57) ABSTRACT

The present disclosure provides an antenna and an electronic device. The antenna includes: a radiator, a feed terminal, a capacitive circuit, a resonant circuit, and a ground terminal. The feed terminal is electrically connected to a preset connection point on the radiator via the capacitive circuit. A first end of the resonant circuit is electrically connected to the radiator, and a second end of the resonant circuit is electrically connected to the ground terminal.

18 Claims, 8 Drawing Sheets

(51) Int. Cl.
*H01Q 1/48* (2006.01)
*H01Q 9/04* (2006.01)

(56) References Cited

U.S. PATENT DOCUMENTS

| | | | | |
|---|---|---|---|---|
| 7,804,457 | B2 * | 9/2010 | Oshiyama | H01Q 1/243 343/749 |
| 8,384,606 | B2 * | 2/2013 | Shoji | H01Q 1/24 343/745 |
| 8,699,964 | B2 * | 4/2014 | Ohba | H01Q 1/243 343/803 |
| 10,283,870 | B2 * | 5/2019 | Nishizono | H01Q 9/32 |
| 2014/0198009 | A1 | 7/2014 | Nagumo | |

FOREIGN PATENT DOCUMENTS

| | | | |
|---|---|---|---|
| CN | 103872452 | A | 6/2014 |
| EP | 2498337 | A1 | 9/2012 |
| EP | 3029767 | A2 | 6/2016 |
| EP | 3070785 | A1 | 9/2016 |

OTHER PUBLICATIONS

European Extended Search Report issued in corresponding EP Application No. 18180011, dated Oct. 18, 2018, 10 pages.

* cited by examiner

ANTENNA AND ELECTRONIC DEVICE

CROSS-REFERENCE TO RELATED APPLICATION

This application is based upon and claims priority to Chinese patent application No. 201710497977.2, filed Jun. 27, 2017, the entire content of which is incorporated herein by reference in its entirety for all purposes.

TECHNICAL FIELD

The present disclosure relates to the technical field of communications, and more particularly, to an antenna and an electronic device.

BACKGROUND

With the development of communications technology, an electronic device such as a smartphone has an increasing demand for having the multi-antenna and the multi-frequency band, and the electronic device also needs a more compact structure. Due to some structural and industrial design limitations, it is difficult for an electronic device to be freely designed entirely based on the requirement for antenna. Therefore, it becomes a technical problem to utilize the structure of the electronic device for implementing the function of transmitting and receiving multi-frequency band signals by an antenna.

SUMMARY

The present disclosure provides an antenna and an electronic device.

According to a first aspect of the present disclosure, an antenna provided in an electronic device is provided. The antenna may include: a radiator, a feed terminal, a capacitive circuit, a resonant circuit, and a ground terminal, where the feed terminal is electrically connected to a preset connection point on the radiator via the capacitive circuit; and a first end of the resonant circuit is electrically connected to the radiator, and a second end of the resonant circuit is electrically connected to the ground terminal.

According to a second aspect the present disclosure, an electronic device is provided. The electronic device may include: a processor; and a memory for storing instructions executable by the processor, where the electronic device may further include an antenna, the antenna including: a radiator, a feed terminal, a capacitive circuit, a resonant circuit, and a ground terminal, where the feed terminal is electrically connected to a preset connection point on the radiator via the capacitive circuit; and a first end of the resonant circuit is electrically connected to the radiator, and a second end of the resonant circuit is electrically connected to the ground terminal.

It should be understood that both the foregoing general description and the following detailed description are exemplary and explanatory only and are not restrictive of the disclosure.

BRIEF DESCRIPTION OF THE DRAWINGS

The accompanying drawings, which are incorporated in and constitute a part of this specification, illustrate examples consistent with the disclosure and, together with the description, serve to explain the principles of the disclosure.

FIG. 2-1 is a schematic diagram illustrating a structure of another antenna according to an example of the present disclosure.

FIG. 2-2 is a schematic diagram illustrating a structure of another antenna according to an example of the present disclosure.

FIG. 4-1 is a schematic diagram illustrating a structure of another antenna according to an example of the present disclosure.

FIG. 4-2 is a schematic diagram illustrating a structure of another antenna according to an example of the present disclosure.

FIG. 4-3 is a schematic diagram illustrating a structure of another antenna according to an example of the present disclosure.

FIG. 5-1 is a schematic diagram illustrating a structure of another antenna according to an example of the present disclosure.

FIG. 5-2 is a schematic diagram illustrating a structure of another antenna according to an example of the present disclosure.

FIG. 5-3 is a schematic diagram illustrating a structure of another antenna according to an example of the present disclosure.

DETAILED DESCRIPTION

Reference will now be made in detail to examples, examples of which are illustrated in the accompanying drawings. The following description refers to the accompanying drawings in which the same numbers in different drawings represent the same or similar elements unless otherwise indicated. The implementations set forth in the following description of examples do not represent all implementations consistent with the disclosure. Instead, they are merely examples of apparatuses and methods consistent with aspects related to the disclosure.

The terms used in the present disclosure are only for the purpose of describing particular examples, and are not intended to limit the present disclosure. Unless the context clearly indicates other meanings, “a”, “the” and “this” in a singular form used in the present disclosure and the appended claims are intended to include “a”, “the” and “this” in a plural form. It also should be understood that the term “and/or” used herein refers to and includes any or all possible combination of one or more listed items associated with each other.

It should be understood that the present disclosure may use the terms “first”, “second”, “third” and the like to describe various information, but the information should not be limited to these terms. These terms are only used to separate the same type of information from one another. For example, a first information may also be referred to as a second information without departing from the scope of the present disclosure, and a second information may also be referred to as a first information similarly. Depending on the context, the term “if” as used herein may be interpreted as “at the time of”, “when” or “in response to determination”.

An antenna is an essential part for an electronic device to realize the function of wireless communication. The present disclosure provides an antenna which is applicable to an electronic device having the function of wireless communication, such as smartphone, tablet device, personal digital assistant, and wearable device (for example, smart watch).

The present disclosure provides an antenna, and the antenna includes: a radiator, a feed terminal, a capacitive circuit, a resonant circuit, and a ground terminal. The feed terminal is electrically connected to a preset connection point on the radiator via the capacitive circuit. A first end of the resonant circuit is electrically connected to the radiator, and a second end of the resonant circuit is electrically connected to the ground terminal.

Figure 1:
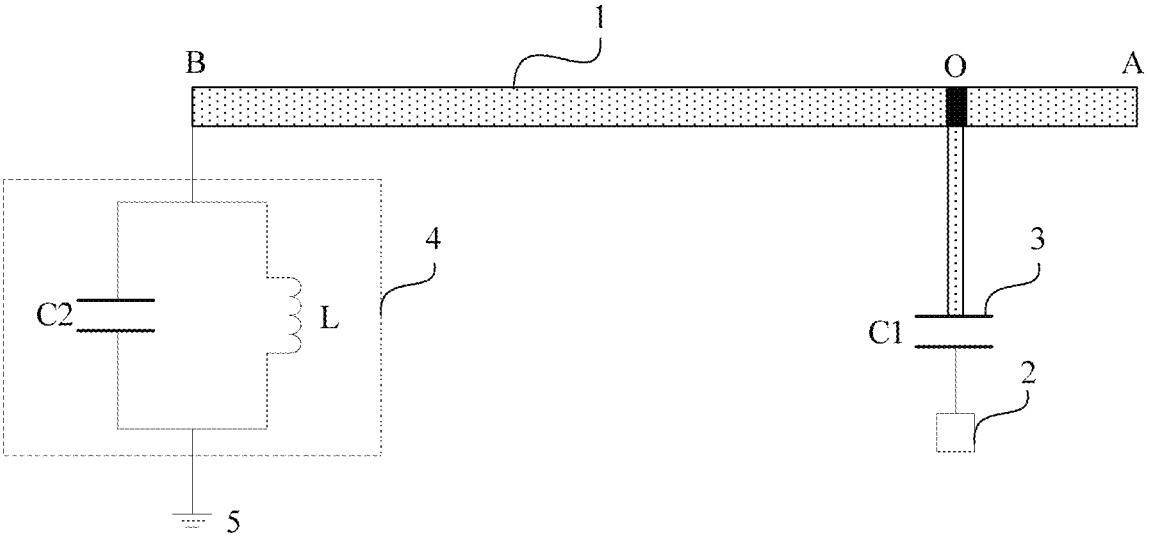
FIG. 1 is a schematic diagram illustrating a structure of an antenna according to an example of the present disclosure.

Referring to FIG. 1 which is a schematic diagram illustrating a structure of an antenna according to an example, the antenna may include: a radiator 1, a feed terminal 2, a first capacitor 3, a parallel resonant circuit 4, and a ground terminal 5. In the example of the present disclosure, the capacitive circuit is embodied as the first capacitor C1, and the resonant circuit is embodied as the parallel resonant circuit 4. The feed terminal 2 is connected to a radio frequency (RF) module (not shown) of the electronic device. By means of the feed terminal 2, the antenna performs RF signal transmission with the RF module.

After the feed terminal 2 is connected with the first capacitor 3 in series, the feed terminal 2 is electrically connected to the radiator 1 at the position of a preset connection point O. In the present disclosure, the position of the connection point O at which the first capacitor 3 connects to the radiator 1 may be determined based on an operating frequency band of the electronic device. The position of the connection point O is adjacent to a first end A of the radiator 1.

A second end B of the radiator 1 is connected to a first end of the parallel resonant circuit 4, and a second end of the parallel resonant circuit 4 is electrically connected to the ground terminal 5.

Figures 1, 2:
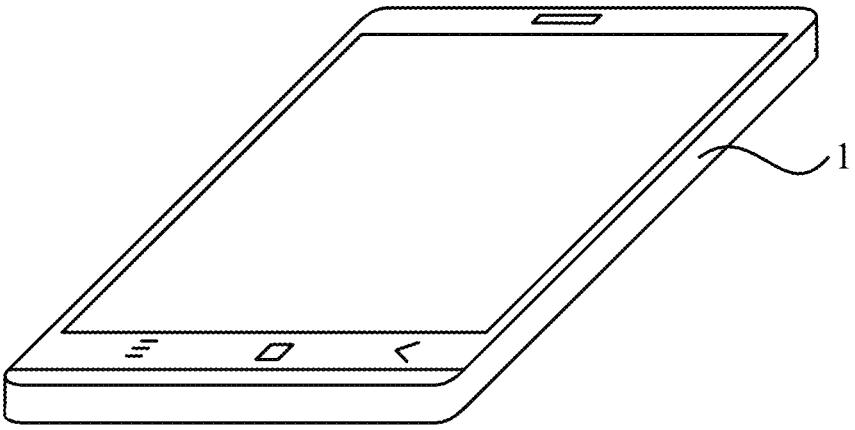
Figure 2:
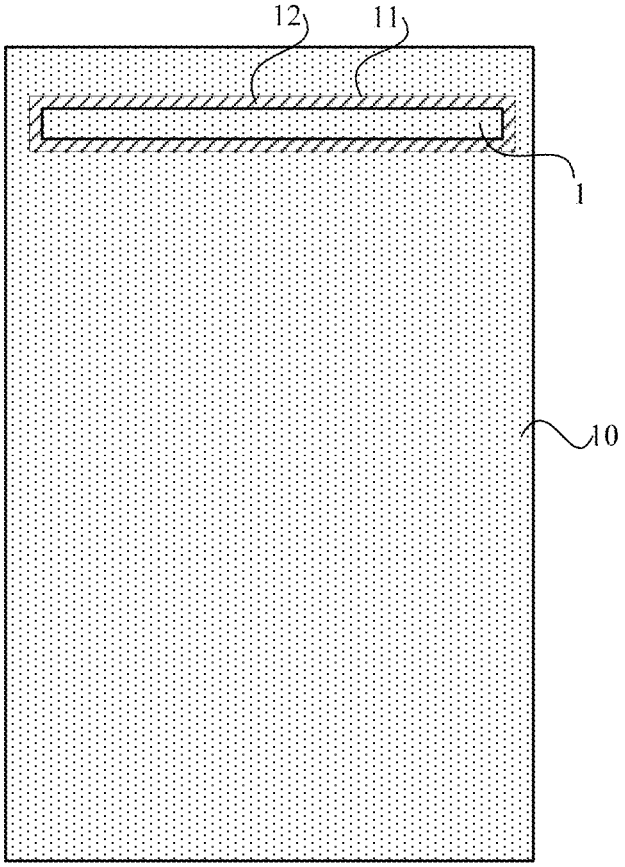

In an example of the present disclosure, the above-mentioned radiator may be a metal frame of the electronic device. Referring to FIG. 2-1 which is a schematic diagram illustrating a structure of an antenna according to an example, a metal frame 1 of a mobile phone may be used as the radiator of the antenna.

In another example of the present disclosure, the above-mentioned radiator may be a metal strap structure separated from the metal shell of the electronic device by an insulating material. Referring to FIG. 2-2 which is a schematic diagram illustrating a structure of another antenna according to an example, a closed groove 11 is provided on the shell 10 of the electronic device, and an insulating material 12 is distributed within the groove 11. By the above-mentioned insulating material 12, a metal strap structure 1 may be separated from the metal shell 10 so as to be used as the radiator of the above-mentioned antenna.

Based on the structure of the above-mentioned antenna, three antenna resonance points may be excited simultaneously by one feed terminal. That is, the antenna provided by the present disclosure allows the radiator to realize three different antenna equivalent lengths simultaneously. Each of the antenna equivalent lengths corresponds to an antenna resonance point of one frequency band. Therefore, three frequency bands are covered, and the three frequency bands may be low frequency, intermediate frequency and high frequency, respectively, of different mobile communication modes, or may be other operating frequency bands.

Figure 3:
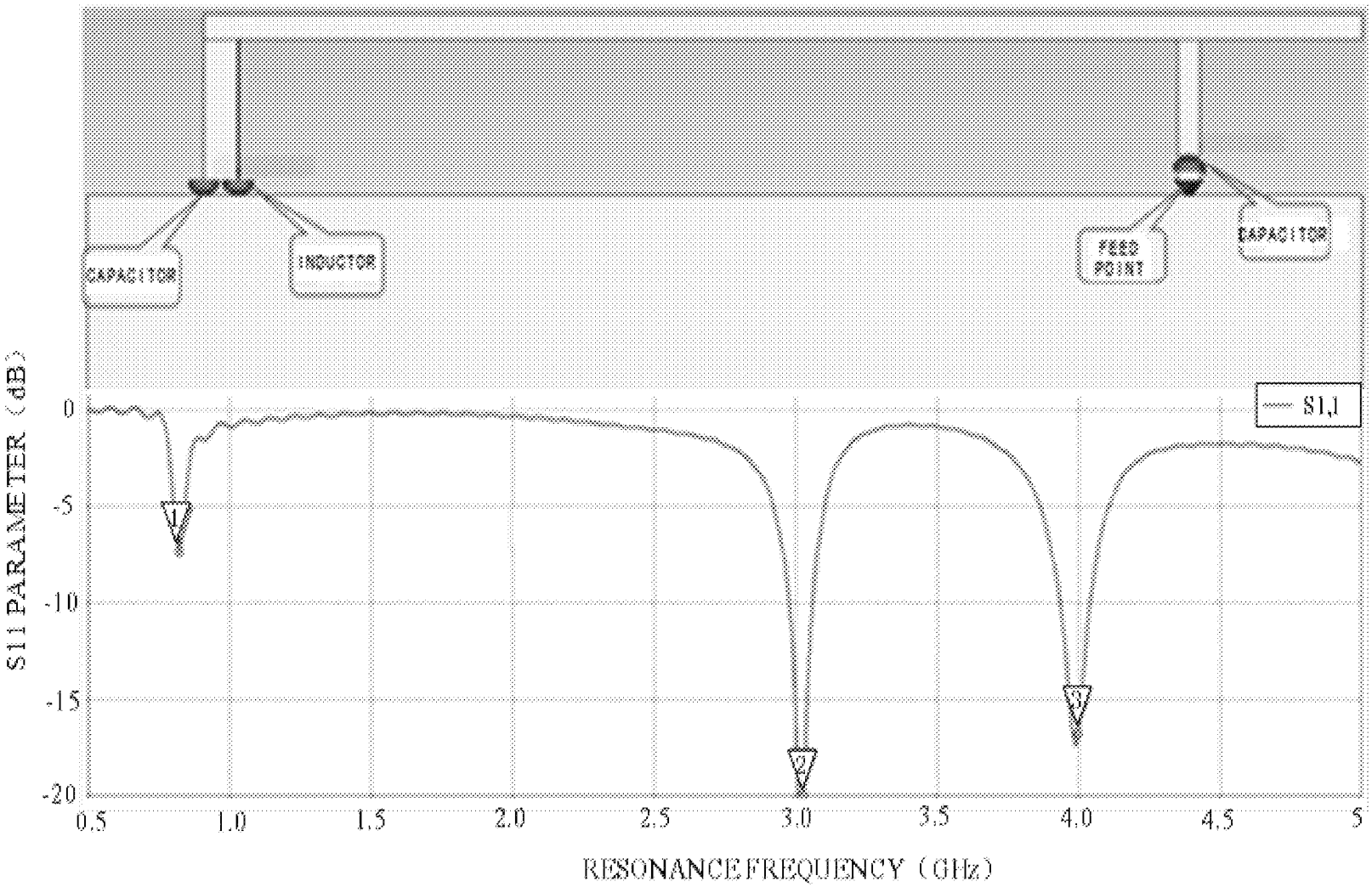
FIG. 3 is a schematic diagram illustrating a simulation model and a corresponding simulation result of the antenna according to an example of the present disclosure.

Referring to FIG. 3 which is a schematic diagram illustrating a simulation model and a corresponding simulation result of the antenna according to an example, the upper portion of FIG. 3 shows the simulation model of the antenna provided by the present disclosure, and the lower portion of FIG. 3 shows the test results of corresponding antenna resonance frequency points. In the lower portion of FIG. 3, parameter S11 of the vertical axis represents echo loss parameter of the antenna, i.e., how much energy is reflected back to the source. The numerical value of vertical axis parameter S11 reflects transmitting efficiency of the antenna, and is inversely proportional to the efficiency of the antenna. That is, the larger the numerical value of vertical axis parameter S11 is, the worse the efficiency of the antenna is. In the lower portion of FIG. 3, horizontal axis parameter represents resonance frequency.

As seen from FIG. 3, the antenna provided by the present disclosure may excite resonance points of three frequency bands, in case the feed terminal is connected to the capacitive circuit and the ground terminal is connected to the resonant circuit. The resonance points are resonance point 1 in low-frequency band, resonance point 2 in intermediate-frequency band and resonance point 3 in high-frequency band, respectively. The resonance frequency corresponding to the resonance point 1 is 800 MHz, the resonance frequency corresponding to the resonance point 2 is 3.1 GHz, and the resonance frequency corresponding to the resonance point 3 is 4 GHz.

In contrast, in some cases where neither the feed terminal nor the ground terminal is provided with the above-mentioned circuits, the resonance point 2 of intermediate-frequency band and the resonance point 3 of high-frequency band as shown in FIG. 3 may be excited, but the resonance point 1 of low-frequency band cannot be excited.

As can be seen, the present disclosure may realize, based on one simple antenna, signal coverage of three frequency bands after a capacitive circuit is connected between the feed terminal and the radiator and a resonant circuit is connected between the radiator and the ground terminal. Using an existing member of the electronic device as a radiator of the antenna, the frequency band coverage of the antenna is expanded and the antenna performance is improved effectively without increasing complexity of the antenna structure.

In other words, without changing the antenna structure, the present disclosure may realize a three-frequency band characteristic of the antenna by only adding a capacitive circuit connected between the feed terminal and the radiator and a resonant circuit connected between the radiator and the ground terminal. The three-frequency band characteristic means that the antenna has three frequency bands in which echo loss is less than −6 dB. The three frequency bands are 800 MHz, 3.1 GHz and 4 GHz, respectively. In this way, three kinds of communication modes may be applicable.

Taking mobile phone as an example of the electronic device, the three-frequency band characteristic of the antenna allows the antenna to simultaneously cover main communication frequency bands employed for current mobile phone communications, thereby achieving the effect that the fourth generation mobile communication system is compatible with the previous mobile communication system such as 2G and 3G communication systems. Specifically, it is a three-frequency band antenna for a mobile phone supporting communication systems such as GSM and LTE.

In another example of the present disclosure, electrical elements of the above-mentioned capacitive circuit and resonant circuit may be adjustable elements.

Figures 1, 4:
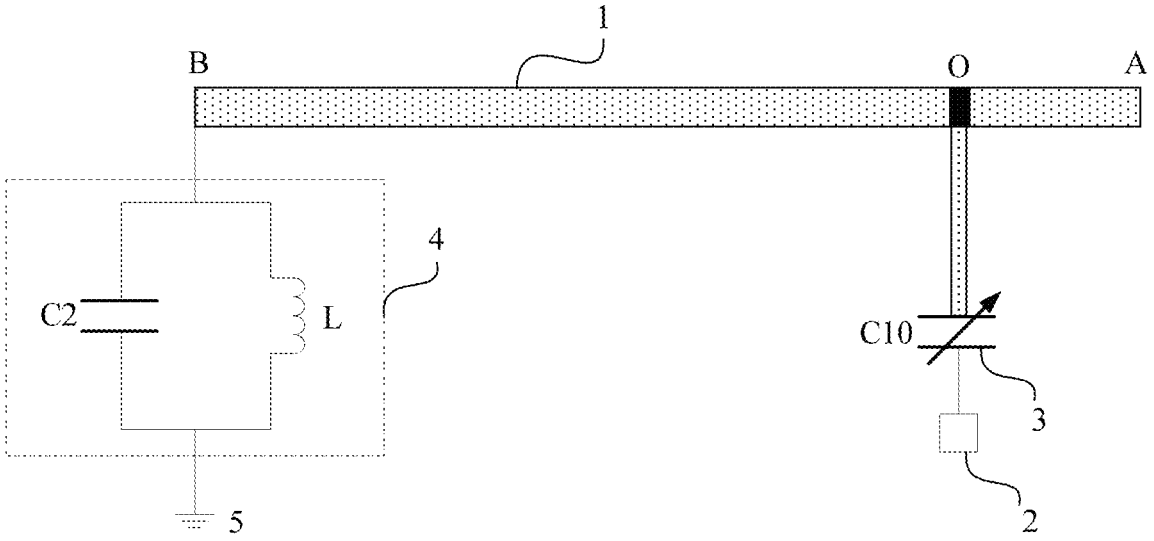
Figures 2, 4:
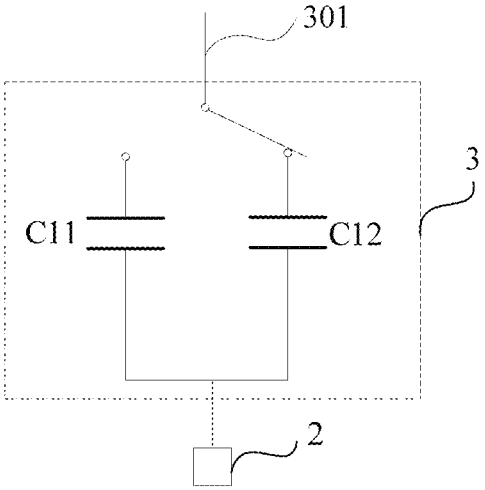
Figures 3, 4:
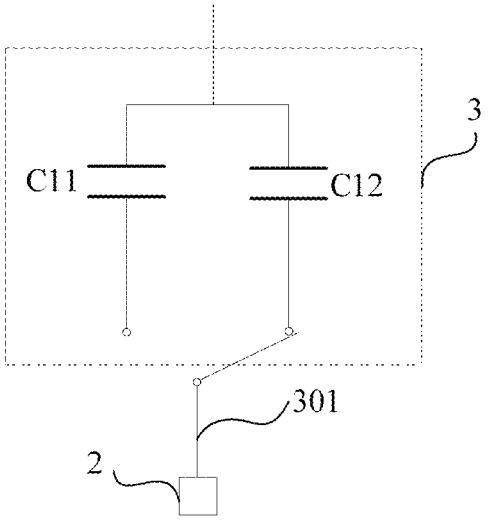

Referring to FIG. 4-1 which is a schematic diagram illustrating a structure of another antenna according to an example, the capacitive circuit 3 connected between the feed terminal 2 and the connection point O may be a variable capacitor C10 with adjustable capacitance value so as to fine adjust the frequency of low-frequency resonance point.

In case where the desired operating frequency band of the electronic device such as mobile phone CDMA 1× is a frequency band of 800 MHz and the frequency of the low-frequency resonance point currently measured on the antenna is slightly lower than 800 MHz (for example, 795 MHz), the capacitance value of the variable capacitor C10 in FIG. 4-1 may be adjusted higher slightly such that the resonance frequency of the resonance point 1 shown in FIG. 3 is increased to 800 MHz. On the contrary, in case where the frequency of the low-frequency resonance point currently measured on the antenna is slightly higher than 800 MHz (for example, 810 MHz), the capacitance value of the variable capacitor C10 in FIG. 4-1 may be adjusted lower slightly such that the resonance frequency of the resonance point 1 is decreased to 800 MHz.

Referring to FIG. 4-2 which is a schematic diagram illustrating a structure of another antenna according to an example, the above-mentioned capacitive circuit may include: a first selective switch; and at least two sub-capacitors connected in a distributed manner. The first selective switch is configured to connect at least one of the at least two sub-capacitors in series with and between the feed terminal and the radiator. The first selective switch may be embodied as a single-pole multi-throw switch 301.

The single-pole multi-throw switch 301 may control the distributed capacitive components to be connected in series with and between the connection point O on the radiator and the feed terminal 2. The capacitive components may include at least two sub-capacitors connected in a distributed manner.

As shown in FIG. 4-2, taking two sub-capacitors C11, C12 as an example and assuming the capacitance value of C11 is 1 pF and the capacitance value of C12 is 1.5 pF, frequency of the resonance point which may be excited after C11 or C12 is connected with the antenna in series is shown in table 1.

TABLE 1

| Capacitor identification | Capacitance value | Resonance frequency |
|---|---|---|
| C11 | 1 pF | 850 MHz |
| C12 | 1.5 pF | 900 MHz |

As known from table 1, when an electronic device is used to perform communication, the sub-capacitor to be connected with the feed terminal in series may be controlled based on operating frequency band corresponding to communication mode of the electronic device. Taking mobile phone as an example, when communication mode of mobile phone includes global system for mobile communications (GSM) mode, the corresponding operating frequency band is a frequency band of 900 MHz. Then, the single-pole multi-throw switch 301 may be controlled to connect the sub-capacitor C12 in series with and between the feed terminal 2 and the connection point O on the radiator 1, such that one resonance point frequency of the antenna is 900 MHz for transmitting and receiving GSM signals.

Similarly, when operating frequency band corresponding to communication mode of mobile phone is a frequency band of 850 MHz, the single-pole multi-throw switch 301 may be controlled to connect the sub-capacitor C11 in series with and between the feed terminal 2 and the connection point O on the radiator 1, such that one resonance point frequency of the antenna is 850 MHz.

In another example of the present disclosure, the single-pole multi-throw switch 301 may be provided between a second end of sub-capacitor components connected in a distributed manner and the feed terminal 2, so as to control at least one sub-capacitor to be electrically connected in series with and between the feed terminal 2 and the connection point O on the radiator 1, as shown in FIG. 4-3.

Figures 1, 5:
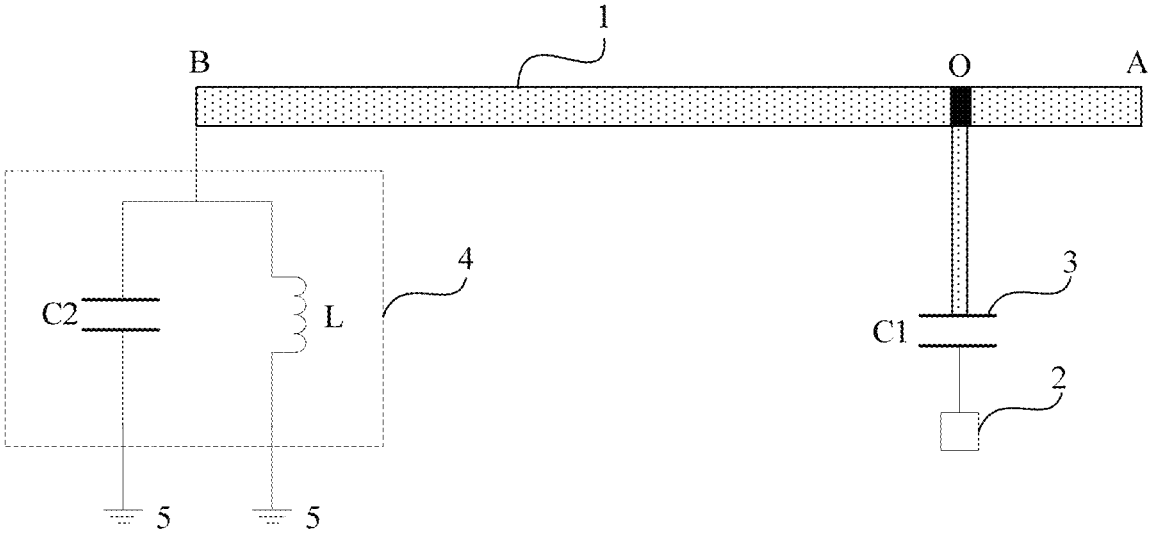
Figures 2, 5:
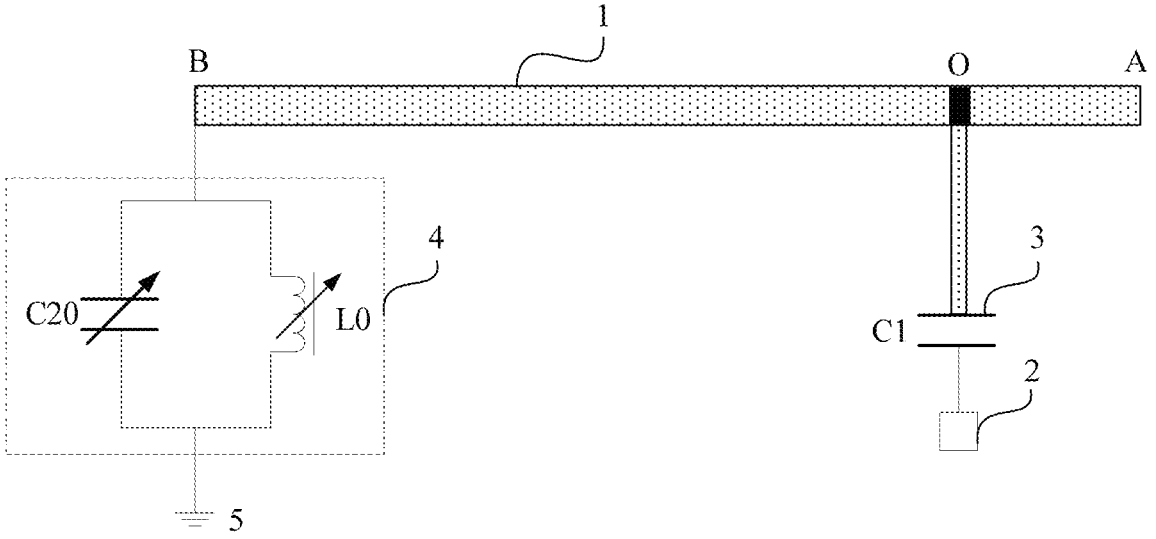
Figures 3, 5:
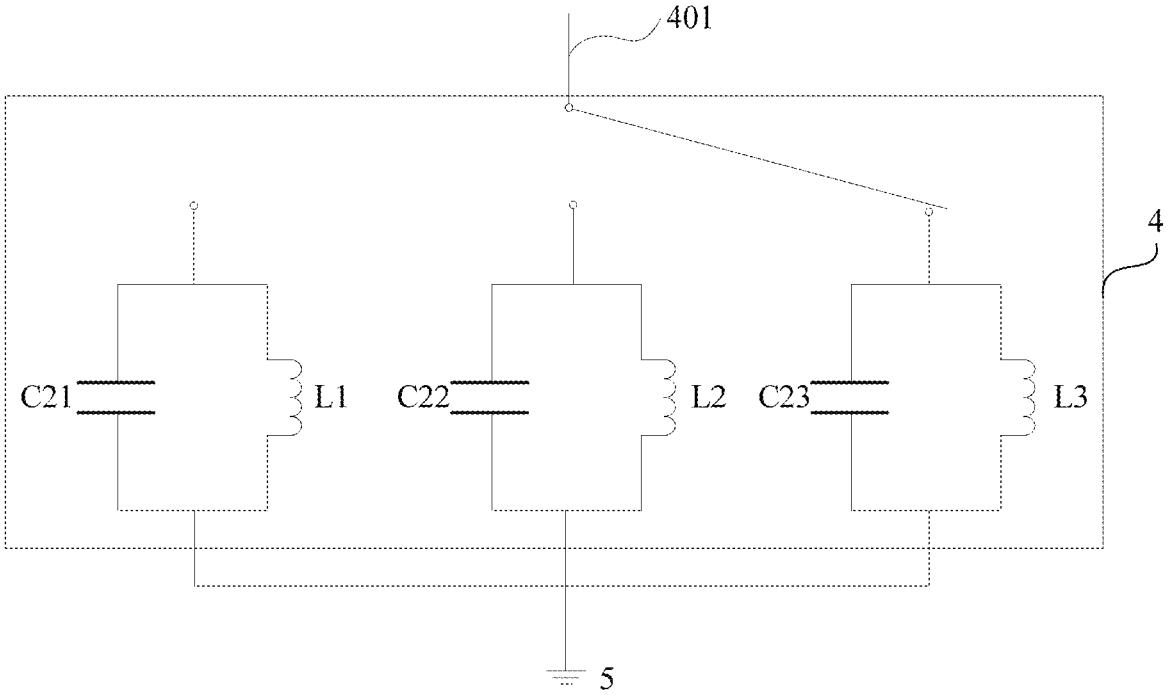

In an example of the present disclosure, as an alternative to the structure of the resonant circuit 4 shown in FIG. 1, such a structure may be used for the resonant circuit 4 that the capacitor C2 and the inductor L, which are connected in parallel, of the above-mentioned resonant circuit may be electrically connected to the ground terminal 5 in a separate manner, i.e., may be respectively electrically connected to the ground terminal 5, referring to FIG. 5-1 which is a schematic diagram illustrating a structure of another antenna according to an example.

In another example of the present disclosure, the capacitor of the above-mentioned parallel resonant circuit may be a variable capacitor C20 and the inductor may be an adjustable inductor L0, referring to FIG. 5-2 which is a schematic diagram illustrating a structure of another antenna according to an example. In the present disclosure, frequencies corresponding to the resonance point 2 and the resonance point 3 shown in FIG. 3 may be fine adjusted by adjusting electrical values of the variable capacitor C20 and the adjustable inductor L0.

In addition, in the present disclosure, the resonant circuit 4 may also be implemented in a distributed manner, i.e., may use a second selective switch to control at least one of at least two sub-resonant circuits connected in a distributed manner to be electrically connected between the ground terminal 5 and the second end B of the radiator 1. Referring to FIG. 5-3 which is a schematic diagram illustrating a structure of another parallel resonant circuit according to an example, the distributed resonant circuit includes three sub-resonant circuits, i.e., a first sub-parallel resonant circuit constituted of a first parallel capacitor C21 and a first parallel inductor L1, a second sub-parallel resonant circuit constituted of a first parallel capacitor C22 and a first parallel inductor L2, and a third sub-parallel resonant circuit constituted of a first parallel capacitor C23 and a first parallel inductor L3. When each of the sub-parallel resonant circuits is connected to the antenna, the frequency generated on the antenna resonance point is different.

FIG. 5-3 illustrates a case where the second selective switch 401 is provided between the first end of the resonant circuit and the second end B of the radiator 1. It may be anticipated that, in another example of the present disclosure, the second selective switch 401 may also be provided between the ground terminal 5 and the second end of the resonant circuit, so as to control sub-resonant circuits to be electrically connected between the ground terminal 5 and the second end B of the radiator 1.

In the antenna provided by the present disclosure, frequencies of three resonance points excited by the feed terminal are the joint result of numerical values of elements in the resonant circuit, capacitance values of capacitors in series, and the position of connection point for the feed terminal to connect to the radiator. Electrical elements of the antenna provided by the present disclosure are adjustable and/or switchable, such that values of electrical elements connected to the antenna are also adjustable. Furthermore, values of electrical elements connected to the antenna affect operating frequency band of the antenna. In practical application, the resonance frequency of the antenna may be adjusted by adjusting parameter values of one or more electrical elements and/or by adjusting position of connection point for the feed terminal to connect to the radiator, in order to meet the operating frequency band requirement for communications of the electronic device.

Moreover, the present disclosure further provides an electronic device, and the electronic device may include: a processor; and a memory for storing instructions executable by the processor. The electronic device further includes an antenna, the antenna including: a radiator, a feed terminal, a capacitive circuit, a resonant circuit, and a ground terminal. The feed terminal is electrically connected to a preset connection point on the radiator via the capacitive circuit. A first end of the resonant circuit is electrically connected to the radiator, and a second end of the resonant circuit is electrically connected to the ground terminal. The above-mentioned electronic device may be a mobile phone having a metal frame or a mobile phone whose frame and rear covers are both made of metal material.

Figure 6:
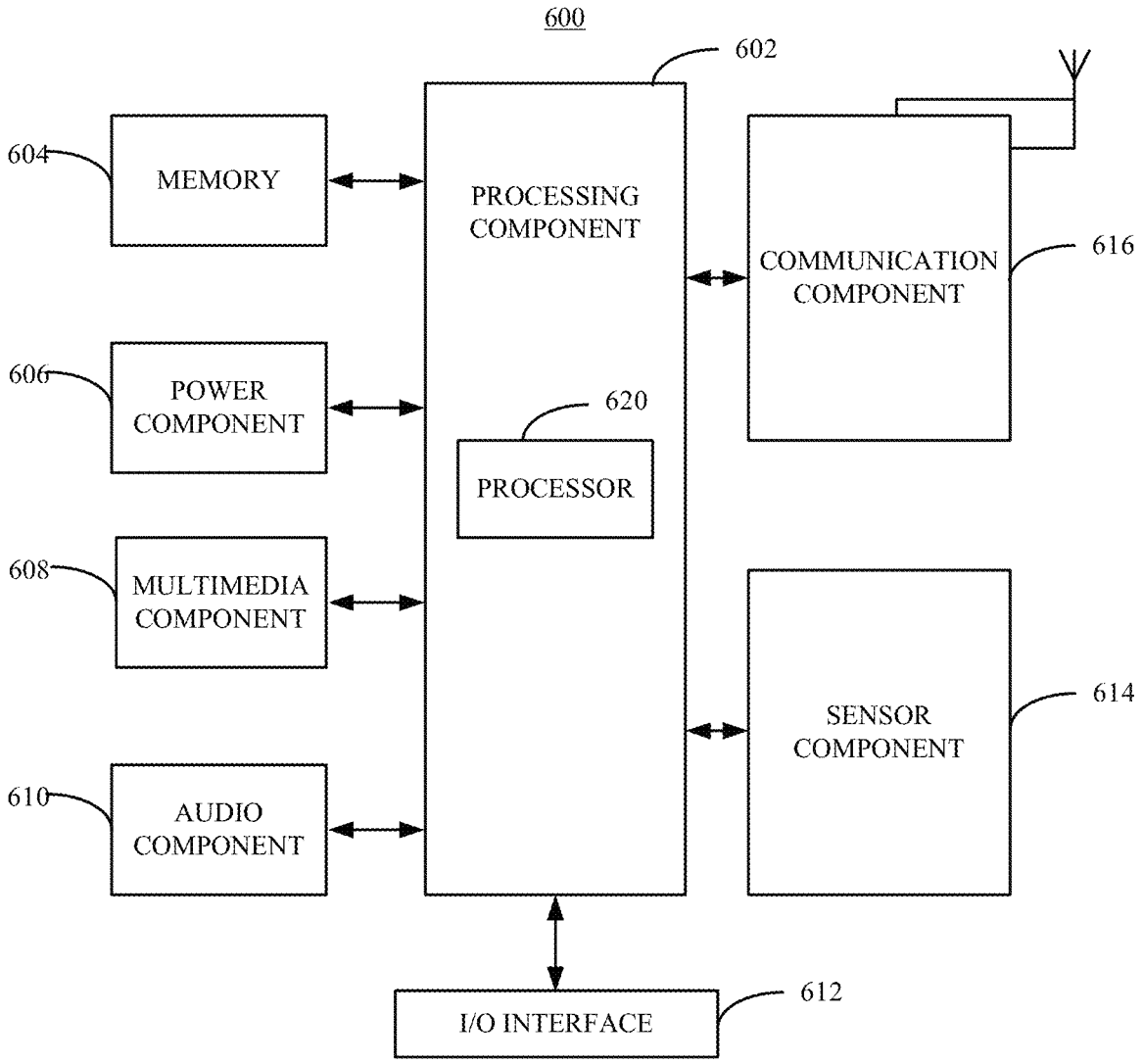
FIG. 6 is a schematic diagram illustrating a structure of an electronic device according to an example of the present disclosure.

Referring to FIG. 6, the electronic device 600 may include one or more of the following components: a processing component 602, a memory 604, a power component 606, a multimedia component 608, an audio component 610, an input/output (I/O) interface 612, a sensor component 614, and a communication component 616.

The processing component 602 typically controls overall operations of the device 600, such as the operations associated with display, phone calls, data communications, camera operations and recording operations. The processing component 602 may include one or more processors 620 to execute instructions. Moreover, the processing component 602 may include one or more modules which facilitate the interaction between the processing component 602 and other components. For example, the processing component 602 may include a multimedia module to facilitate the interaction between the multimedia component 608 and the processing component 602.

The memory 604 is configured to store various types of data to support operations of the device 600. Examples of such data include instructions for any applications or methods operated on the device 600, contact data, phonebook data, messages, pictures, video, etc. The memory 604 may be implemented by using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 606 provides power to various components of the device 600. The power component 606 may include a power supply management system, one or more power sources, and any other components associated with the generation, management, and distribution of power in the device 600.

The multimedia component 608 includes a screen providing an output interface between the device 600 and the user. In some examples, the screen may include a liquid crystal display (LCD) and a touch panel (TP). If the screen includes the touch panel, the screen may be implemented as a touch screen to receive input signals from the user. The touch panel includes one or more touch sensors to sense touches, swipes and gestures on the touch panel. The touch sensors may not only sense a boundary of a touch or swipe action, but also sense a period of time and a pressure associated with the touch or swipe action. In some examples, the multimedia component 608 includes a front camera and/or a rear camera. The front camera and/or the rear camera may receive an external multimedia datum while the device 600 is in an operation mode, such as a photographing mode or a video mode. Each of the front camera and the rear camera may be a fixed optical lens system or have focus and optical zoom capability.

The audio component 610 is configured to output and/or input audio signals. For example, the audio component 610 includes a microphone (MIC) configured to receive an external audio signal when the device 600 is in an operation mode, such as a call mode, a recording mode, and a voice recognition mode. The received audio signal may be further stored in the memory 604 or transmitted via the communication component 616. In some examples, the audio component 610 further includes a speaker to output audio signals.

The I/O interface 612 provides an interface between the processing component 602 and peripheral interface modules, such as a keyboard, a click wheel, buttons, and the like. The buttons may include, but are not limited to, a home button, a volume button, a starting button, and a locking button.

The sensor component 614 includes one or more sensors to provide status assessments of various aspects of the device 600. For instance, the sensor component 614 may detect an open/closed status of the device 600, relative positioning of components, e.g., the display and the keypad, of the device 600, a change in position of the device 600 or a component of the device 600, a presence or absence of user's contact with the device 600, an orientation or an acceleration/deceleration of the device 600, and a change in temperature of the device 600. The sensor component 614 may include a proximity sensor configured to detect the presence of nearby objects without any physical contact. The sensor component 614 may also include a light sensor, such as a CMOS or CCD image sensor, for use in imaging applications. In some examples, the sensor component 614 may also include an accelerometer sensor, a gyroscope sensor, a magnetic sensor, a pressure sensor or a temperature sensor.

The communication component 616 is configured to facilitate communication, wired or wirelessly, between the device 600 and other devices. The device 600 can access a wireless network based on a communication standard, such as WiFi, 2G, 3G, 4G or 5G or a combination thereof. In one example, the communication component 616 receives a broadcast signal or broadcast associated information from an external broadcast management system via a broadcast channel. In one example, the communication component 616 further includes a near field communication (NFC) module to facilitate short-range communications. For example, the NFC module may be implemented based on a radio frequency identification (RFID) technology, an infrared data association (IrDA) technology, an ultra-wideband (UWB) technology, a Bluetooth (BT) technology, and other technologies.

In examples, the device 600 may be implemented with one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components.

The present disclosure provides an antenna and an electronic device so that the electronic device has a function of transmitting and receiving signals in three frequency bands simultaneously, thereby improving antenna performance.

According to a first aspect of the examples of the present disclosure, an antenna provided in an electronic device is provided and includes: a radiator, a feed terminal, a capacitive circuit, a resonant circuit, and a ground terminal, wherein the feed terminal is electrically connected to a preset connection point on the radiator via the capacitive circuit; and a first end of the resonant circuit is electrically connected to the radiator, and a second end of the resonant circuit is electrically connected to the ground terminal.

Optionally, the capacitive circuit includes a variable capacitor.

Optionally, the capacitive circuit includes: a first selective switch; and at least two sub-capacitors connected in a distributed manner, wherein the first selective switch is configured to connect at least one of the at least two sub-capacitors in series with and between the feed terminal and the radiator.

Optionally, a second end of a capacitor of the resonant circuit and a second end of an inductor of the resonant circuit are electrically connected to the ground terminal after being connected together, or are respectively electrically connected to the ground terminal.

Optionally, the resonant circuit includes: a second selective switch; and at least two sub-resonant circuits connected in a distributed manner, wherein the second selective switch is configured to electrically connect at least one of the at least two sub-resonant circuits between the ground terminal and the radiator.

Optionally, the capacitor and the inductor of the resonant circuit are a variable capacitor and an adjustable inductor, respectively.

Optionally, the radiator is a metal frame of the electronic device.

Optionally, the radiator is a metal strap structure separated from the metal shell of the electronic device by an insulating material.

Optionally, a position of the preset connection point at which the first capacitor connects to the radiator is adjusted based on a desired operating frequency band of the electronic device.

According to a second aspect of the examples of the present disclosure, an electronic device is provided and includes:

a processor; and a memory for storing instructions executable by the processor, wherein the electronic device further includes an antenna, the antenna including: a radiator, a feed terminal, a capacitive circuit, a resonant circuit, and a ground terminal, wherein the feed terminal is electrically connected to a preset connection point on the radiator via the capacitive circuit; and a first end of the resonant circuit is electrically connected to the radiator, and a second end of the resonant circuit is electrically connected to the ground terminal.

The technical solutions provided by the examples of the present disclosure may have the following advantageous effects.

The antenna provided by the present disclosure may realize the transmission and reception of radio signals in three frequency bands simultaneously by a simple structure. The electronic device, to which the antenna provided by the present disclosure is applied, operates in three frequency bands. With the simple structure design, the frequency band coverage of the electronic device is expanded effectively, and the antenna performance of the electronic device is enhanced. Meanwhile, the antenna is accomplished based on the existing metal member of the electronic device, and the antenna has features of simple structure, small space-occupation, and so on.

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the computing system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors.

Other examples of the disclosure will be apparent to those skilled in the art from consideration of the specification and practice of the disclosure disclosed here. This application is intended to cover any variations, uses, or adaptations of the disclosure following the general principles thereof and including such departures from the present disclosure as come within known or customary practice in the art. It is intended that the specification and examples be considered as exemplary only.

It will be appreciated that the present disclosure is not limited to the exact construction that has been described above and illustrated in the accompanying drawings, and that various modifications and changes can be made without departing from the scope thereof.

The invention claimed is:

1. An antenna provided in an electronic device, comprising:

a radiator, a feed terminal, a capacitive circuit, a resonant circuit, and a ground terminal, wherein the feed terminal is electrically connected to a preset connection point on the radiator via the capacitive circuit, the position of the preset connection point on the radiator is adjustable and determined based on an operating frequency band of the electronic device; and a first end of the resonant circuit is electrically connected to the radiator, and a second end of the resonant circuit is electrically connected to the ground terminal.

2. The antenna of claim 1, wherein the capacitive circuit comprises a variable capacitor.

3. The antenna of claim 1, wherein the capacitive circuit comprises: a first selective switch, and at least two sub-capacitors connected in a distributed manner, wherein the first selective switch is configured to connect at least one of the at least two sub-capacitors between the feed terminal and the radiator, and is configured to connect the at least one of the at least two sub-capacitors with the feed terminal and the radiator in series.

4. The antenna of claim 1, wherein the resonant circuit comprises a capacitor and an inductor, and a second end of the capacitor and a second end of the inductor are connected before they are electrically connected to the ground terminal, or the second end of the capacitor and the second end of the inductor are connected to the ground terminal separately.

5. The antenna of claim 1, wherein the resonant circuit comprises: a second selective switch, and at least two sub-resonant circuits connected in a distributed manner, wherein the second selective switch is configured to electrically connect at least one of the at least two sub-resonant circuits between the ground terminal and the radiator.

6. The antenna of claim 1, wherein the resonant circuit comprises a capacitor and an inductor, and the capacitor is a variable capacitor and the inductor is an adjustable inductor.

7. The antenna of claim 1, wherein the radiator comprises a metal frame of the electronic device.

8. The antenna of claim 1, wherein the radiator comprises a metal strap structure that is separated from a metal shell of the electronic device by an insulating material.

9. The antenna of claim 1, wherein the position of the preset connection point is adjacent to a first end of the radiator, the first end of the radiator is in opposite to a second end of the radiator, and the second end of the radiator is electronically connected to the first end of the resonant circuit.

10. An electronic device, comprising:

a processor; and a memory for storing instructions executable by the processor, wherein the electronic device further comprises an antenna, and the antenna comprises:

a radiator, a feed terminal, a capacitive circuit, a resonant circuit, and a ground terminal, wherein the feed terminal is electrically connected to a preset connection point on the radiator via the capacitive circuit, the position of the preset connection point on the radiator is adjustable and determined based on an operating frequency band of the electronic device; and a first end of the resonant circuit is electrically connected to the radiator, and a second end of the resonant circuit is electrically connected to the ground terminal.

11. The electronic device of claim 10, wherein the capacitive circuit comprises a variable capacitor.

12. The electronic device of claim 10, wherein the capacitive circuit comprises: a first selective switch, and at least two sub-capacitors connected in a distributed manner, wherein the first selective switch is configured to connect at least one of the at least two sub-capacitors between the feed terminal and the radiator, and is configured to connect the at least one of the at least two sub-capacitors with the feed terminal and the radiator in series.

13. The electronic device of claim 10, wherein the resonant circuit comprises a second end of a capacitor, and a second end of the capacitor and a second end of the inductor are connected before they are electrically connected to the ground terminal, or the second end of the capacitor and the second end of the inductor are connected the ground terminal separately.

14. The electronic device of claim 10, wherein the resonant circuit comprises: a second selective switch, and at least two sub-resonant circuits connected in a distributed manner, wherein the second selective switch is configured to electrically connect at least one of the at least two sub-resonant circuits between the ground terminal and the radiator.

15. The electronic device of claim 10, wherein the resonant circuit comprises a capacitor and an inductor, and the capacitor is a variable capacitor and the inductor is an adjustable inductor.

16. The electronic device of claim 10, wherein the radiator comprises a metal frame of the electronic device.

17. The electronic device of claim 10, wherein the radiator comprises a metal strap structure that is separated from a metal shell of the electronic device by an insulating material.

18. The electronic device of claim 10, wherein the position of the preset connection point is adjacent to a first end of the radiator, the first end of the radiator is in opposite to a second end of the radiator, and the second end of the radiator is electronically connected to the first end of the resonant circuit.

* * * * *